US012723584B2

(12) United States Patent
Reinhard et al.

(10) Patent No.: US 12,723,584 B2
(45) Date of Patent: Sep. 1, 2026

(54) DOSING PUMP WITH STROKE ADJUSTMENT

(71) Applicant: ProMinent GmbH, Heidelberg (DE)

(72) Inventors: Martin Reinhard, Heidelberg (DE); Maximilian Göpfert, Mannheim (DE)

(73) Assignee: ProMinent GmbH, Heidelberg (DE)

( * ) Notice: Subject to any disclaimer, the term of this patent is extended or adjusted under 35 U.S.C. 154(b) by 435 days.

(21) Appl. No.: 18/340,060

(22) Filed: Jun. 23, 2023

(65) Prior Publication Data

US 2023/0417229 A1 Dec. 28, 2023

(30) Foreign Application Priority Data

Jun. 27, 2022 (DE) ..... 102022115955.8

(51) Int. Cl.

| | |
|---|---|
| ***F04B 49/14*** | (2006.01) |
| ***F04B 9/02*** | (2006.01) |
| ***F04B 13/00*** | (2006.01) |
| ***F04B 43/02*** | (2006.01) |

(52) U.S. Cl.

CPC ..... *F04B 49/14* (2013.01); *F04B 9/02* (2013.01); *F04B 13/00* (2013.01); *F04B 43/02* (2013.01)

(58) Field of Classification Search

CPC ..... F04B 13/00; F04B 43/02; F04B 49/14; F04B 9/02; F04B 49/12

USPC ..... 417/395, 413.1; 92/101

See application file for complete search history.

(56) References Cited

U.S. PATENT DOCUMENTS 3,164,024 A * 1/1965 Mitchell ..... F04B 49/12 92/13
4,192,223 A * 3/1980 Lombard ..... F04B 49/121 92/99
5,037,277 A * 8/1991 Tan ..... F16K 17/0433 137/540
5,074,757 A * 12/1991 Horn ..... F04B 43/009 417/63

(Continued)

FOREIGN PATENT DOCUMENTS

DE 1653662 A1 12/1971
DE 219543 A1 3/1985

(Continued)

OTHER PUBLICATIONS

Search Report issued on Mar. 7, 2023, in corresponding German Application No. 102022115955.8, 8 pages.

*Primary Examiner* — Charles G Freay
*Assistant Examiner* — Joseph S. Herrmann
(74) *Attorney, Agent, or Firm* — Maier & Maier, PLLC

(57) ABSTRACT

A dosing pump for conveying a fluid, having a displacement element and a dosing chamber, the displacement element delimiting the dosing chamber and being movable back and forth on a movement axis between a pressure position and a suction position, a drive being able to apply a driving force to the displacement element in the direction of the pressure position. A restoring force is exerted on the displacement element in the direction of the suction position by a biasing element. A stop element is provided which limits the movement of the displacement element in the direction of the suction position, and the stop element can be adjusted along the axis of movement via a control element which can be moved along a control axis in order to set a dosing volume of the dosing pump.

20 Claims, 2 Drawing Sheets

(56) References Cited

U.S. PATENT DOCUMENTS 5,249,932 A * 10/1993 Van Bork ..... F04B 43/067
417/63

FOREIGN PATENT DOCUMENTS

| | | | |
|---|---|---|---|
| DE | 3928411 | A1 | 3/1991 |
| DE | 3931516 | A1 | 4/1991 |
| DE | 202005013089 | U1 | 1/2007 |
| DE | 202005013090 | U1 | 1/2007 |
| DE | 102007005736 | A1 | 8/2008 |
| DE | 102007030311 | A1 | 1/2009 |
| DE | 102016119930 | A1 | 4/2018 |
| DE | 102020125757 | A1 | 4/2022 |
| WO | 9305293 | A1 | 3/1993 |
| WO | 2019219122 | A1 | 11/2019 |

* cited by examiner

DOSING PUMP WITH STROKE ADJUSTMENT

FIELD

The present invention relates to a dosing pump for delivering a dosing volume of a fluid, having a displacement element and a dosing chamber, wherein the displacement element delimits the dosing chamber and can be moved back and forth between a pressure position and a suction position on a movement axis, wherein a volume of the dosing chamber in the pressure position of the displacement element is smaller than a volume of the dosing chamber in the suction position of the displacement element, wherein a drive is provided, with which a driving force can be applied to the displacement element in the direction of the pressure position, wherein a biasing element is provided which exerts a restoring force on the displacement element in the direction of the suction position, wherein a stop element is provided which limits the movement of the displacement element in the direction of the suction position, wherein the stop element is adjustable along the axis of movement in order to adjust the suction position of the displacement element.

BACKGROUND

Dosing pumps are used in a wide variety of technical fields. For example, they are used for dosing pharmaceuticals or chemicals in chemical processes, for dosing culture media in bio-technical processes, in coating processes, in the food industry or in motor vehicles, for example as injection pumps. As diverse as the possible uses for dosing pumps are, so are the requirements placed on dosing pumps in industry for various applications. Depending on the application, the dosing pumps are used to convey the smallest quantities of liquid in the millilitre or microlitre range up to significantly larger quantities.

The dosing volume delivered by a dosing pump can also vary during a single application, for example depending on the amount of fluid required in certain process steps.

In order to be able to use dosing pumps effectively in industry, it is often desirable to adjust the dosing volume that can be delivered with the dosing pump individually. Furthermore, it is desirable that the dosing volume of the dosing pump can also be adjusted during operation of the dosing pump. Adjustment should be as simple as possible and as cost-effective as possible.

Various solutions are known from the prior art for adjusting the dosing volume of a dosing pump. One solution is to control the drive of the dosing pump so that a certain dosing volume is delivered. Starting from a hydraulic pump, for example, the movement of a hydraulic piston can be controlled in such a way that the pressure of the hydraulic fluid, which leads to the movement of the displacement element, only varies in a certain range and thus the dosing volume is adjusted.

Another solution known from the prior art is to couple the movement of a drive piston, which drives a displacement element, to an eccentric shaft, which adjustably limits a stroke movement of the piston, in that the eccentric shaft only moves in an adjustable range and the piston is thus also only moved in a certain range. In this case, however, the eccentric shaft is loaded with the full driving force of the drive, which is why there are high demands on such a stroke length adjustment device, particularly with regard to stability. Furthermore, the eccentric shaft also requires additional installation space and the connection between the eccentric shaft and the piston is more susceptible to failure due to its complexity alone than the simplest possible de-sign for stroke length limitation.

Another alternative solution is to limit the movement of the drive or the displacement element by means of a metallic stop. In this case, the limiting element can be adjusted e.g. by a spindle parallel to the axis of movement of the displacement element. Since the eccentricity of mechanically driven displacement elements is relatively short compared to e.g. hydraulically displaced displacement elements, the disadvantage arises that the entire adjustment range of the limiting element and thus of the dosing volume is usually covered by a few rotations. The resolution of a scale of the dosing volume, which can be adjusted with the metallic stop, is correspondingly limited. Fine tuning of the dosing volume is thus not possible.

The possibilities known from the prior art for adjusting a dosing volume of a dosing pump are therefore usually very complex, costly to manufacture and/or only offer a low accuracy for adjusting the dosing volume.

SUMMARY

The present invention is therefore based on the problem of providing a dosing pump for delivering a dosing volume of a fluid, which offers a simple, inexpensive and mechanical adjustment option for adjusting the dosing volume of a dosing pump.

The problem underlying the invention is solved by a dosing pump of the type mentioned at the beginning, wherein a control element is provided, wherein the control element is arranged in such a way that the control element can be moved along a control axis which encloses an angle $\alpha>0°$, preferably $\alpha=90°$, with the axis of movement, the control element being arranged on the stop element in such a way that a movement of the stop element is coupled to a movement of the control element, so that the stop element can be adjusted along the axis of movement by a movement of the control element along the control axis.

The dosing volume of the dosing pump is thus adjusted by adjusting the stop element along the axis of movement by moving the control element along the control axis. The stop element is thus not adjusted directly by applying force to the stop element in the direction of the movement axis, but by adjusting the control element along the control axis. The force required to adjust the stop element is therefore not directly dependent on the restoring force of the displacement element.

For the purposes of the present invention, coupling of the movements of the control element and the stop element should be understood to mean that a movement of the control element is not possible without a movement of the stop element, and vice versa. If the control element is thus fixed in a certain position, the stop element is also fixed in a certain position.

Depending on the position of the stop element, the suction position of the displacement element changes and thus the volume of the dosing chamber in the suction position of the displacement element. Thus, a dosing volume can be set with the dosing pump depending on the positioning of the stop element.

By coupling the movements of the control element with the movement of the stop element and translating the movement of the control element along the control axis into a movement of the stop element along the axis of movement, the accuracy of the adjustment of the dosing volume is improved. Thus, a large movement of the control element can lead to a comparatively small movement of the stop element, which simplifies the precise adjustment of the dosing volume.

In particular, in one embodiment, the stop element is arranged in the dosing pump in such a way that the drive force does not act on the stop element and preferably does not act on the control element. Thus, a stop element is provided that mechanically limits the movement of the displacement element in the direction of the suction position, but does not come into contact with a moving element of the drive that exerts the driving force on the displacement element.

This means that the stop element according to the invention is subjected to less force compared to stroke length adjustment devices known from the prior art, so that the wear of the stop element is less and the stop element can be designed to be less stable than is the case with devices known from the prior art.

In one embodiment, the displacement element has a drive surface and a stop surface, wherein the drive applies the drive force to the drive surface during an operation of the dosing pump, wherein the stop surface comes into contact with the stop element in the suction position. The stop element thus comes into contact with the displacement element in a different area, namely in the area of the stop surface, than the drive, which comes into contact with the displacement element in the area of the drive surface. This ensures that the drive forces do not act on the stop element.

In a further embodiment, an actuator is provided which is coupled to the control element, wherein the actuator is designed in such a way that the control element can be adjusted along the control axis with the actuator, wherein preferably the actuator has a blocking element, wherein a movement of the control element is prevented with the blocking element when the blocking element is activated. The actuator therefore does not act directly on the stop element, but exerts a force in the direction of the control axis on the control element, which in turn leads to a movement of the stop element along the axis of movement.

In particular, in a further embodiment, the actuator can have a spindle which is supported in a threaded bore in a housing of the dosing pump. The actuator can thus be operated manually from the outside so that an adjustment of the dosing volume by adjusting the position of the stop element along the axis of movement by moving the control element is also possible during operation of the dosing pump without having to open a housing of the dosing pump.

In a further embodiment, the control element and the stop element have two mutually corresponding, flat, surfaces, wherein the two corresponding surfaces enclose an angle of between and 90° with both the axis of movement and the control axis, wherein the two mutually corresponding surfaces are configured and aligned in such a way, that the corresponding surfaces are in contact with each other and slide along each other in a direction of movement when the stop element is displaced along the axis of movement due to a movement of the control element along the control axis, wherein the direction of movement lies in a plane spanned by the control axis and the axis of movement.

In particular, in one embodiment, an angle $\beta$ which the two mutually corresponding surfaces enclose with the control axis is chosen between 5° and 45°, wherein preferably $10° > \beta > 35°$ and particularly preferably $\beta = 14°$. It is understood that an angle $\gamma$ which the corresponding surfaces enclose with the axis of movement needs not be identical to the angle $\beta$ which the surfaces enclose with the control axis.

The force required to move the stop element along the axis of movement is reduced depending on the angle which the two corresponding surfaces enclose with the axis of movement and the control axis. The smaller the angle $\beta$ enclosed by the two corresponding surfaces with the control axis, the lower the force required to adjust the stop element. At the same time, an adjustment distance that can be achieved by the control element is increased compared to a larger angle. This can be exploited to make a precise, small-step adjustment of the dosing volume. Conversely, a smaller adjustment distance with less movement of the control element can be achieved by a larger angle $\beta$ between the control axis and the corresponding surfaces. The angle of the two corresponding surfaces can thus be selected in such a way that an optimal usage behaviour results for the respective application.

An optimal ratio between the required adjustment force and adjustment distance per unit of movement of the control element can be achieved for many applications if the two corresponding surfaces enclose an angle of 14° with the axis of movement.

In a further embodiment, the two corresponding surfaces are configured, preferably roughened, in such a way that the restoring force is insufficient to cause a relative movement between the corresponding surfaces. In other words, the forces acting on the stop element and the control element due to the restoring movement of the displacement element do not lead to a relative movement between the stop element and the control element. An additional fixation between the stop element and the control element is therefore unnecessary. The relative position between the stop element and the control element can thus be achieved by fixing the control element, for example by locking the actuator.

In a further embodiment, the stop element and the control element are positively connected to each other, the positive connection allowing relative movement between the control element and the stop element exclusively in one direction along the corresponding surfaces, the direction lying in a plane spanned by the control axis and the axis of movement. For example, in one embodiment, the stop element has a bead extending beyond an outer surface that engages a groove of the control element or vice versa. In this way, it can be ensured that a movement of the control element along the control axis leads exclusively to a movement of the stop element along the axis of movement and thus the adjustability of the stop element takes place with a high degree of accuracy.

In a further embodiment, the drive comprises a drive housing, wherein the stop element and preferably the control element each comprise an opening for at least partially receiving the drive housing, wherein particularly preferably a portion of the drive housing is positively arranged in the opening of the stop element, so that the stop element can be moved exclusively along the axis of movement, while between the opening of the control element and a section of the drive housing which is accommodated in the opening of the control element, a distance is provided which permits movement of the control element along the control axis.

Ultimately, movement of the control element along the control axis must not be prevented by the drive housing. For this reason, a certain distance must be provided between the two elements so that the adjustability of the stop element along the axis of movement is made possible. The arrangement of the stop element and the control element on or around a drive housing offers a simple way of fixing the stop element and the control element without exposing them to the drive force.

In particular, the drive housing of the actuator may be a guide sleeve in which a preferably cylindrical piston of the drive performs a stroke movement to move the displacement element into the pressure position. If the stop element and the control element are arranged in such a way that they surround the drive housing, the elements do not experience any force exerted by the piston on the displacement element.

In a further embodiment, the stop element and preferably the control element are detachably arranged in the dosing pump. If the dosing pump is to be operated at full power, the stroke length limitation provided by the stop element and the control element can thus be easily re-moved, so that the dosing pump according to the invention can be used in many ways.

In a further embodiment of the dosing pump according to the invention, the stop element is arranged in a housing of the dosing pump in such a way that the stop element is not coupled to the movement of the displacement element. Preferably, the control element is also not coupled to the movement of the displacement element. This offers the advantage that the stop element according to the invention as well as the control element are not subjected to high forces that have to be absorbed with particularly stable materials. Both the stop element and the control element can thus be designed cost-effectively.

In a further embodiment, the stop element and preferably the control element is therefore a plastic component.

In a further embodiment, the displacement element comprises a diaphragm and a contact element connected to the diaphragm, the contact element being adapted to contact both the actuator and the stop element.

BRIEF DESCRIPTION OF THE FIGURES

Further advantages, features and possible applications of the present invention will become apparent from the following description of an embodiment and the accompanying figures. Identical components are marked with the same reference signs.

DETAILED DESCRIPTION

Figure 1:
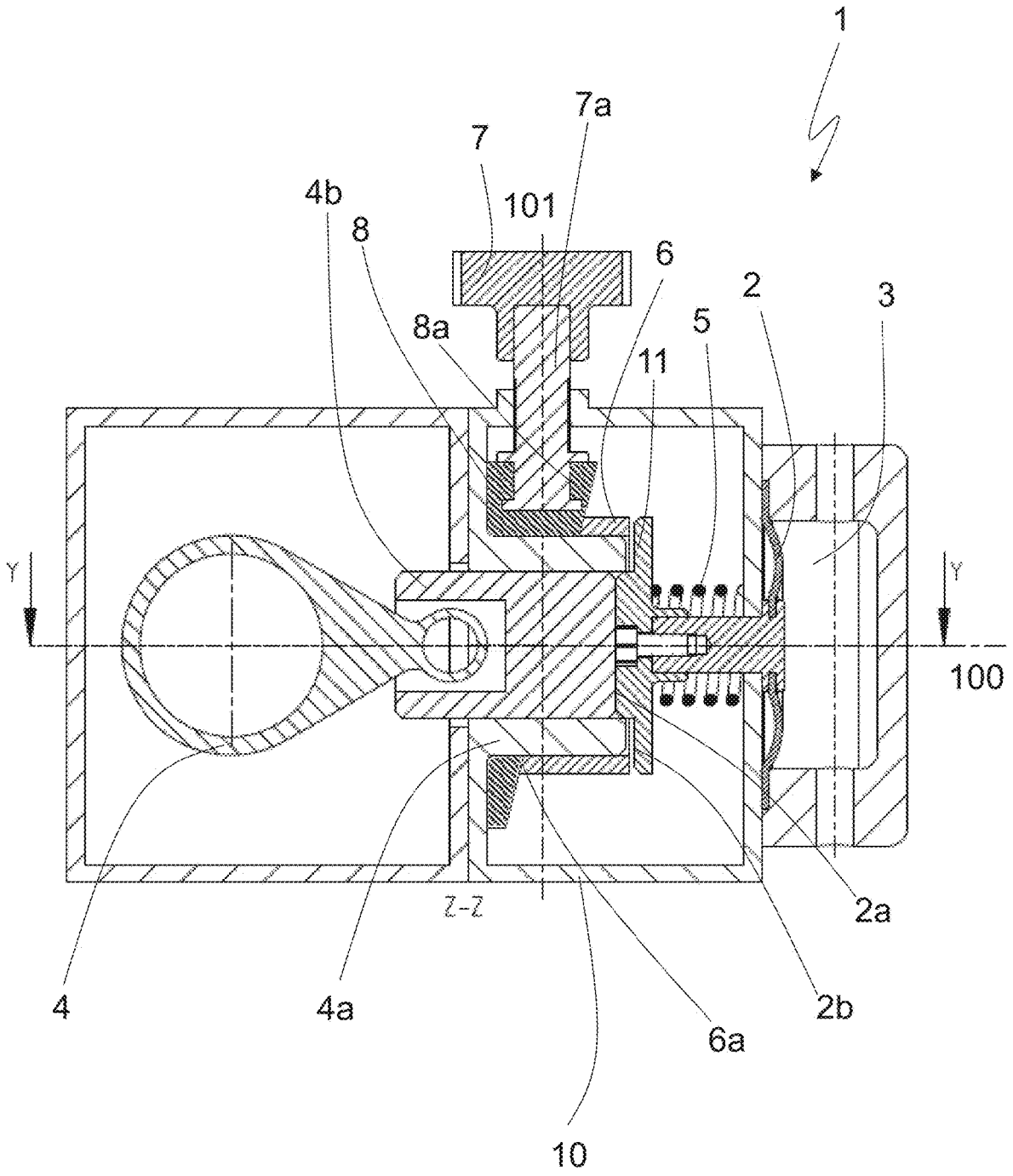
FIG. 1 shows a schematic representation of a section through an embodiment of the dosing pump according to the invention.
Figure 2:
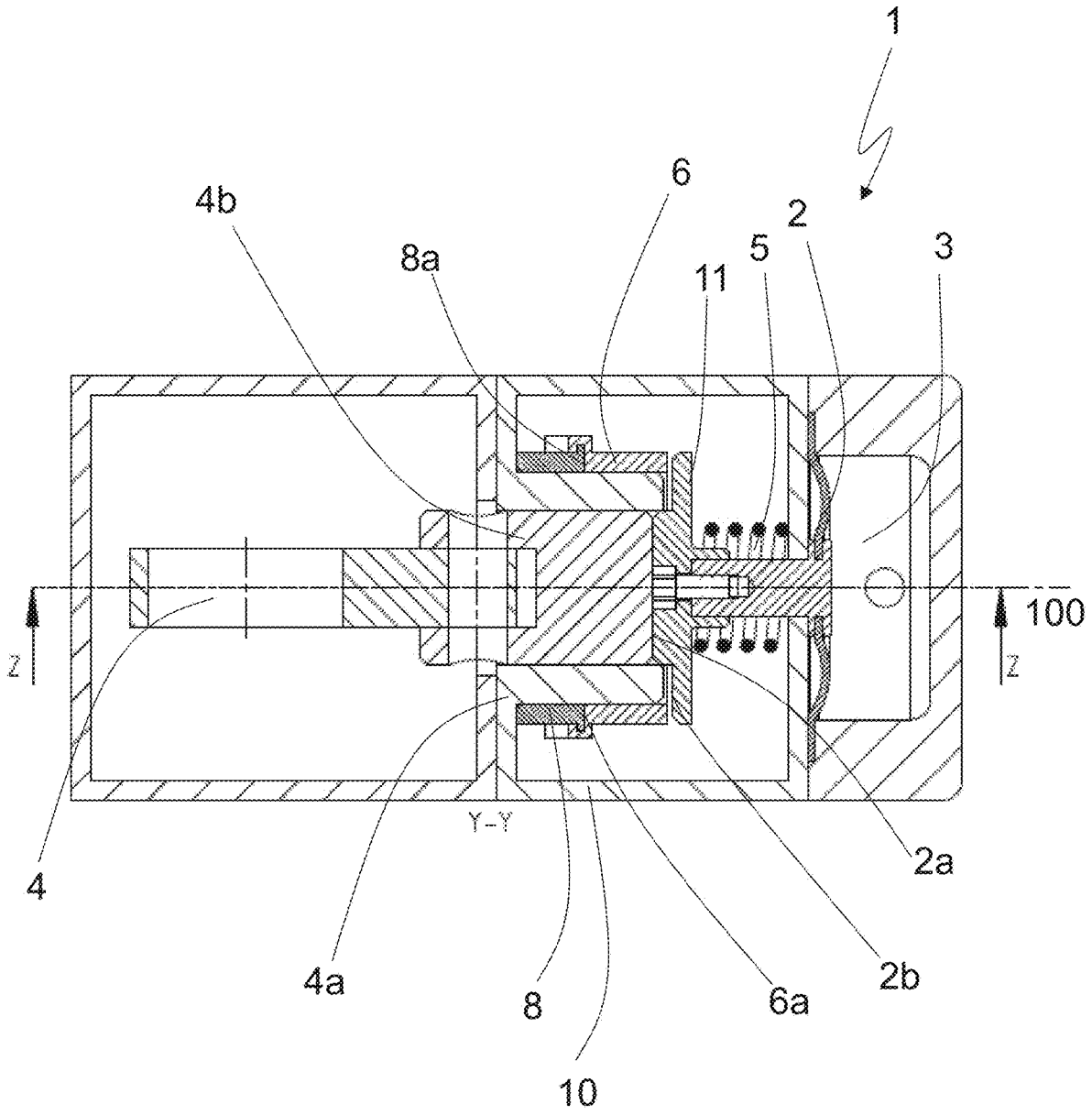
FIG. 2 shows a schematic representation of a section perpendicular to the section shown in FIG. 1.

The dosing pump 1 shown in FIGS. 1 and 2 has a displacement element 2 and a dosing chamber 3, the displacement element 2 delimiting the dosing chamber 3. The displacement element 2 can be moved back and forth between a pressure position and a suction position on an axis of movement 100. In this case, a volume of the dosing chamber 3 in the pressure position of the displacement element 2 is smaller than a volume of the dosing chamber 3 in the suction position of the displacement element 2.

During operation of the dosing pump 1, the drive 4 applies a driving force to the displacement element 2 in the direction of the pressure position in order to move the displacement element 2 into the pressure position. This results in emptying of the dosing chamber 3. In order to return the displacement element 2 from the pressure position to the suction position, the dosing pump 1 has a biasing element 5 in the form of a spring which exerts a restoring force on the displacement element 2.

In detail, the displacement element 2 is designed as a diaphragm with a contact element 11, the contact element 11 having a drive surface 2*a*, to which the drive 4 applies the drive force, and a stop surface 2*b*.

The stop surface 2*b* of the contact element 11 of the displacement element 2 is designed to come into contact with a stop element 6 of the dosing pump 1 when the displacement element 2 is arranged in the suction position. The stop element 6 is designed in such a way that it limits the movement of the displacement element 2 in the direction of the suction position.

The drive 4 essentially has a drive housing 4*a* in the form of a guide sleeve in which a piston 4*b* is guided.

As can be seen from the figures, a section of the drive housing 4*a* is accommodated in a precise fit in an opening in the stop element 6 so that the stop element 6 can move exclusively along the axis of movement 100.

A position of the stop element 6 can be adjusted via a control element 8, which also encloses a section of the drive housing 4*a*. As shown in FIG. 1, a distance is provided between the drive housing 4*a* and the control element 8 which allows the control element 8 to move along a control axis 101. The control axis 101 includes an angle of 90° with the axis of movement 100.

In order to move the control element 8 further along the control axis 101, an actuator 7 with a spindle 7*a* is provided, which is supported in a threaded bore of the housing 10 of the dosing pump and applies a force to the control element in the direction of the control axis 101.

In order that a movement of the control element 8 along the control axis 101 leads to a movement of the stop element 6 along the axis of movement 100, the control element 8 and the stop element 6 have corresponding surfaces 6*a*, 8*a*. The two corresponding surfaces 6*a* and 8*a* form an angle of $\beta=14°$ with the control axis 101.

If a user of the dosing pump 1 actuates the actuator 7, for example via an actuating button outside the housing 10, this leads to a movement of the control element 8 in the direction of the control axis 101, which in turn leads to a movement of the stop element 6 along the movement axis 100, whereby the two corresponding surfaces 6*a*, 8*a* slide along each other. This adjusts the pressure position of the displacement element 2 and thus the dosing volume of the dosing pump 1.

As shown in FIG. 2, the stop element 6 and the control element 8 are positively connected to each other by means of a tongue and groove connection. This positive connection only allows a relative movement between the control element 8 and the stop element 6 along the corresponding surfaces 6*a*, 8*a*.

The corresponding surfaces 6*a* and 8*a* are configured such that an amount of a frictional force acting between the two surfaces 6*a*, 8*a* exceeds an amount of the restoring force exerted by the biasing element 5 on the displacement element 2. Alternatively, the frictional force between the corresponding surfaces 6*a* and 8*a* can be made as small as possible and a movement of the stop element 6 relative to the control element 8 can be prevented by an additional, not shown, locking element on the actuator 7 when the dosing pump 1 is in operation.

Due to the arrangement of the stop element 6 and the control element 8 around the drive housing 4*a*, the stop element 6 and the control element 8 are only exposed to the restoring force of the biasing element 5. For this reason, it is sufficient to manufacture the stop element 6 as well as the control element 8 from a plastic component. The displacement element 2 only comes into contact with the stop element 6 via the stop surfaces 2*b* of the contact element 11.

Both the stop element 6 and the control element 8 are thus decoupled from the drive 4. This allows a simple and cost-effective way of specifically adjusting the suction position of the displacement element 2 and thus the dosing volume of a dosing pump 1.

It is also possible to remove the stop element 6 and the control element 8 from the dosing pump 1, as these are detachably connected to the drive housing 4*a* by the tongue and groove connection.

The dosing pump according to the invention can thus be used flexibly both for applications in which the dosing volume is to be varied and for applications in which no variable limitation of the suction position is required.

LIST OF REFERENCE SIGNS

1 Dosing pump
2 Displacement element
2*a* Drive surface
2*b* Stop surface
3 Dosing chamber
4 Drive
4*a* Drive housing
4*b* Piston
5 Biasing element
6 Stop element
6 Corresponding surface of the stop element
7 Actuator
7*a* Spindle
8 Control element
8 Corresponding surface of the control element
10 Housing
11 Contact element
100 Axis of movement
101 Control axis

The invention claimed is:

1. A dosing pump for delivering a dosing volume of a fluid having a displacement element and a dosing chamber, wherein the displacement element delimits the dosing chamber and can be moved back and forth between a pressure position and a suction position on an axis of movement, wherein a volume of the dosing chamber in the pressure position of the displacement element is smaller than a volume of the dosing chamber in the suction position of the displacement element, wherein a drive is provided with which a driving force can be applied to the displacement element in the direction of the pressure position, wherein a biasing element is provided which exerts a restoring force on the displacement element in the direction of the suction position, wherein a stop element is provided which limits the movement of the displacement element in the direction of the suction position, wherein the stop element can be adjusted along the axis of movement in order to adjust the suction position of the displacement element, wherein a control element is provided, wherein the control element is arranged in such a way that the control element can be moved along a control axis which forms an angle $\alpha>0°$ with the axis of movement, the control element being arranged on the stop element in such a way that a movement of the stop element is coupled to a movement of the control element, so that the stop element can be adjusted along the axis of movement by the movement of the control element along the control axis, wherein the stop element is arranged in the dosing pump in such a way that the driving force does not act on the stop element, and wherein the control element and the stop element have two mutually corresponding surfaces, wherein the two mutually corresponding surfaces form an angle of between 0° and 90° both with the axis of movement and with the control axis, wherein the two mutually corresponding surfaces are configured and aligned in such a way that the corresponding surfaces are in contact with one another and slide along one another in a direction of movement when the stop element is displaced along the axis of movement due to the movement of the control element along the control axis, wherein the direction of movement lies in a plane spanned by the control axis and the axis of movement.

2. The dosing pump according to claim 1, wherein the stop element is arranged in the dosing pump in such a way that the driving force does not act on the control element.

3. The dosing pump according to claim 1, wherein the displacement element has a drive surface and a stop surface, wherein the drive applies the driving force to the drive surface during an operation of the dosing pump, wherein the stop surface comes into contact with the stop element in the suction position.

4. The dosing pump according to claim 1, wherein the stop element and the control element are a plastic component.

5. The dosing pump according to claim 1, wherein an actuator is provided which is coupled to the control element, wherein the actuator is designed in such a way that the control element can be adjusted along the control axis with the actuator.

6. The dosing pump according to claim 5, wherein the actuator has a spindle which is supported in a threaded bore in a housing of the dosing pump.

7. The dosing pump according to claim 1, wherein an angle $\beta$ is the angle which the two mutually corresponding surfaces form with the control axis, wherein $5°>\beta>45°$.

8. The dosing pump according to claim 7, wherein $10°>\beta>35°$.

9. The dosing pump according to claim 1, wherein the two mutually corresponding surfaces are configured in such a way that the restoring force is insufficient to cause a relative movement between the corresponding sur-faces.

10. The dosing pump according to claim 9, wherein the two mutually corresponding surfaces are roughened.

11. The dosing pump according to claim 1, wherein the stop element and the control element are positively connected to each other, wherein the positive connection allows a relative movement between the control element and the stop element exclusively in a direction along the two mutually corresponding surfaces, said direction lying in the plane spanned by the control axis and the movement axis.

12. The dosing pump according to claim 1, wherein the drive has a drive housing, wherein the stop element has an opening for at least partial reception of the drive housing.

13. The dosing pump according to claim 12, wherein the control element has an opening for at least partial reception of the drive housing.

14. The dosing pump according to claim 13, wherein a section of the drive housing is arranged in a form-fitting manner in the opening of the stop element, so that the stop element can be moved exclusively along the axis of movement, while a distance is provided between the opening of the control element and a section of the drive housing which is accommodated in the opening of the control element, wherein the distance permits movement of the control element along the control axis.

15. The dosing pump according to claim 1, wherein the stop element is detachably arranged in the dosing pump.

16. The dosing pump according to claim 15, wherein the control element is detachably arranged in the dosing pump.

17. The dosing pump according to claim 1, wherein the displacement element comprises a diaphragm as well as a contact element connected to the diaphragm, wherein the contact element is provided to contact both the drive and the stop element.

18. The dosing pump according to claim 1, wherein the stop element is arranged in a housing of the dosing pump in such a way that the stop element is not coupled to the movement of the displacement element.

19. The dosing pump according to claim 1, wherein the stop element is a plastic component.

20. The dosing pump according to claim 1, wherein the stop element is arranged in a housing of the dosing pump in such a way that the stop element and the control element are not coupled to the movement of the displacement element.

* * * * *